United States Patent [19]

Urdea et al.

[11] 4,165,089

[45] Aug. 21, 1979

[54] FLEXIBLE SKATEBOARD

[76] Inventors: Myron G. Urdea, 1790 Panay Cir., Costa Mesa, Calif. 92626; Doyle Darch, 3130 Rita Wy., Santa Ana, Calif. 92704; John N. Urdea, 21551 Brookhurst, Apt. 6, Huntington Beach, Calif. 92646

[21] Appl. No.: 865,032

[22] Filed: Dec. 27, 1977

Related U.S. Application Data

[63] Continuation of Ser. No. 710,968, Aug. 2, 1976, abandoned.

[51] Int. Cl.[2] ..... A63C 17/02

[52] U.S. Cl. ..... 280/87.04 A

[58] Field of Search ..... 280/87.04 A, 87.04 R, 280/11.1 R, 11.1 BT, 11.11, 11.28, 11.27, 11.19, 602

[56] References Cited

U.S. PATENT DOCUMENTS

| | | | |
|---|---|---|---|
| 3,153,543 | 10/1964 | Magyar | 280/87.04 A |
| 3,795,409 | 3/1974 | Cudmore | 280/87.04 A |
| 3,870,324 | 3/1975 | Balstad | 280/11.28 |
| 3,901,521 | 8/1975 | Famolare, Jr. | 280/11.28 |
| 3,926,449 | 12/1975 | Wilje | 280/11.1 BT |
| 3,954,279 | 5/1976 | Guerr | 280/87.04 A |
| 4,029,330 | 6/1977 | Runyan, Jr. | 280/11.27 |
| 4,058,323 | 11/1977 | Ware, Jr. | 280/11.28 |

FOREIGN PATENT DOCUMENTS

| | | | |
|---|---|---|---|
| 523923 | 4/1955 | Italy | 280/11.1 BT |

OTHER PUBLICATIONS

"Roller Sports", Skateboarder Magazine, Aug. 1976, p. 3.

*Primary Examiner*—David M. Mitchell

*Attorney, Agent, or Firm*—Knobbe, Martens, Olson, Hubbard & Bear

[57] ABSTRACT

A skateboard having an adjustable feature to vary board flexibility to accommodate the performance requirements of various maneuvers executed by the individual using the skateboard. Variable board flexibility is accomplished by the use of a strengthening member mounted on the bottom of the skateboard by an adjusting mechanism which varies the connection between the strengthening member and the skateboard. The skateboard also incorporates integrally cast wheel assembly mounting brackets located on the bottom of the respective ends of the skateboard. In one embodiment of the variable flexion skateboard adjustment dials are positioned at each end of the strengthening member to set the desired flexibility in the skateboard.

6 Claims, 8 Drawing Figures

FLEXIBLE SKATEBOARD

This is a continuation of application Ser. No. 710,968 filed Aug. 2, 1976 and now abandoned.

BACKGROUND OF THE INVENTION

This invention relates to the field of skateboards and more particularly is directed to flexible skateboards. In recent years the sport of skateboarding has become so popular among young persons that numerous competitive meets are held to determine those most proficient in the ability to maneuver the skateboard through various skateboard courses or tracks. Not only are skilled maneuvers required to successfully run a skateboard along a predetermined course, but also additional skilled maneuvers are necessary to accomplish various trick and unique movements.

However, in order to reach the maximum performance levels of those skilled in the sport it is necessary to have a skateboard which possesses the necessary structural characteristics for compatibility with the performance requirements of the various critical maneuvers. One of the more important features required in a skateboard is flexibility. In skateboard competition certain maneuvers require substantial flexibility in the skateboard while other maneuvers require essentially a rigid skateboard, or for other reasons a skateboarder may desire differing flexibility at different times. Consequently, when an individual is entering a competition or is using a skateboard for his own personal enjoyment, he is often forced to utilize two or three different skateboards each of which has the specific flexibility or rigidity required for the maneuver which the individual is to perform.

With the increased popularity of the skateboard, the wheel assembly design has been greatly improved including ball bearing arrangements as well as the overall truck design which carries the wheels and attaches to the skateboard. Consequently, the users of skateboards are able to obtain significant speeds on the skateboard. However, there has been a significant safety hazard with respect to the brackets utilized to attach the wheel assemblies to the skateboard. In many instances, due to the vibrations and fatigue experienced by the connection between the wheel assembly mounting bracket and the skateboard, failure has occurred, causing the wheel assembly to break off the board resulting in possible injury to the user. In most of the prior art, the skateboard is made of a wood or fiber material while the mounting brackets for the wheel assemblies are made of some type of metal which is bolted onto the board itself. It is the connection between the mounting bracket and the board that becomes loosened due to vibration and in some cases actually disconnects from the board.

SUMMARY OF THE INVENTION

The present skateboard comprises an integral board having a thickness greater at its respective ends than in its central portion wherein wheel assembly mounting brackets are integrally formed on the bottom of each of the thickened end portions. Mounted to the bottom surface of the thinner central portion is a strengthening member each end of which is connected to the board through the use of a spring-biased bolt and adjustment knob assembly. The truck assemblies with their respective wheels are attached to each of the integral mounting brackets.

The adjustment knobs at each end of the strengthening member can be turned to a plurality of positions between a locked position against the ends of the strengthening member or a loosened position away from the respective ends of the strengthening member. When the adjustment knobs are in their complete locked position on the respective ends of the strengthening member, the board will be essentially rigid with no flex in the central portion. However, as each of the respective adjustment knobs are loosened, flex will be noted in the central portion of the board when the weight of a typical young person is applied on the skateboard. Maximum deflection will be permitted when the respective adjustment knobs are at their complete loosened position on the attachment bolts.

With the above-described skateboard an individual will find that a single skateboard of this construction will be sufficient to accomplish the various maneuvers which require either a rigid or a flexible skateboard. By simply adjusting the control knobs at each end of the strengthening member the individual can adjust the skateboard to produce an essentially rigid board or a highly flexible board.

The integrally constructed mounting brackets in the skateboard eliminate the loosening of the wheel assembly from the board and avoid possible damage to the board and injury to the user.

In an alternate embodiment of the invention, a strengthening member is located beneath the central portion of the board and has a plurality of apertures throughout its length. In alignment with the apertures in the strengthening member are a plurality of similar apertures in the board. A pair of bolts are inserted in selected aligned apertures and depending upon their location the flexibility of the board is varied. In other words, when the bolt and nut assemblies are tightened at the remote ends of the strengthening member, the board will be rigid. However, as the respective bolt and nut assemblies are moved aperture by aperture inward toward the longitudinal center of the board, the flexibility will increase to a maximum when the bolt and nut assemblies are in the longitudinal center portion of the board and strengthening member.

DETAILED DESCRIPTION OF THE INVENTION

Figure 1:
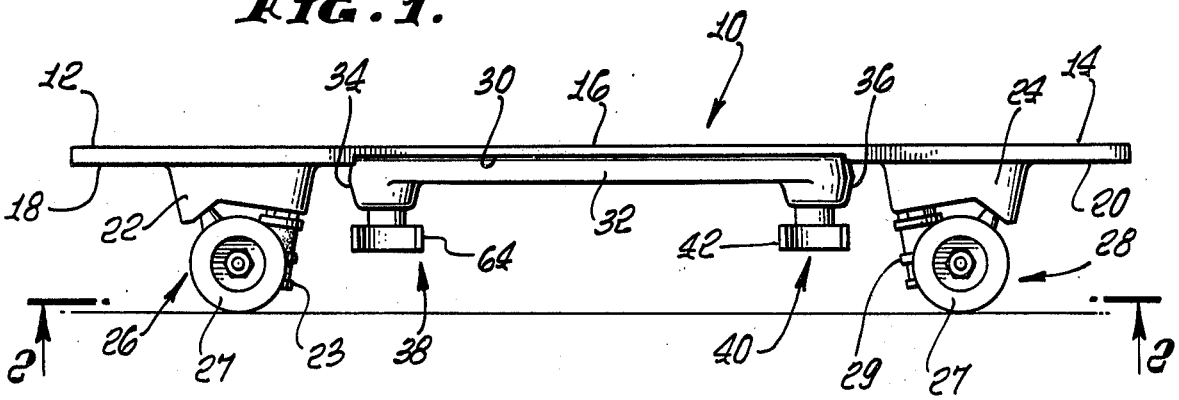
FIG. 1 is a side elevational view of the invention.
Figure 2:
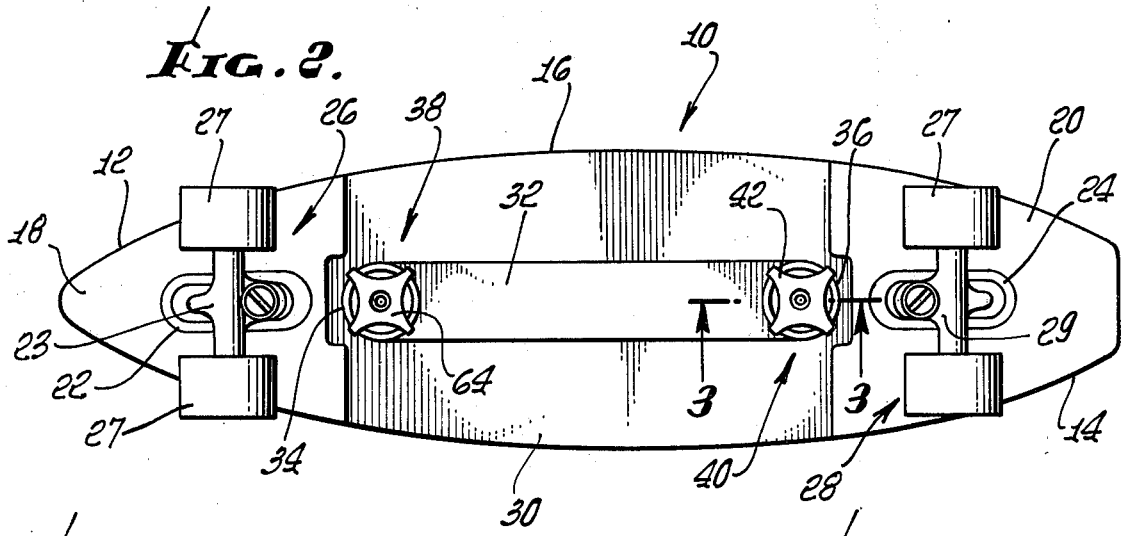
FIG. 2 is a bottom view.

FIG. 1 shows the skateboard 10 having a front portion 12 and a rear portion 14 separated by an integral central portion 16 which is thinner than the thickened end portions 12 and 14. Extending downward integrally from the respective bottom surfaces 18 and 20 of the respective front and rear portions 12 and 14, are wheel assembly mounting legs 22 and 24. The front wheel assembly 26 with its truck 23 and wheels 27 is connected into the front mounting leg 22 while the rear wheel assembly 28 with its truck 29 and wheels 27 is connected into the rear mounting leg 24. Mounted on the bottom surface 30 of the central portion 16 of the board 10 is a strengthening member 32 having a respective front end 34 and rear end 36. The strengthening member or beam 32 is connected at each end to the central portion 16 by respective front and rear flexibility control assemblies 38 and 40. The beam 32 is a rigid beam which will not deflect any substantial amount under loads which would be applied to it by a human standing on it or on the board 10.

Figure 3:
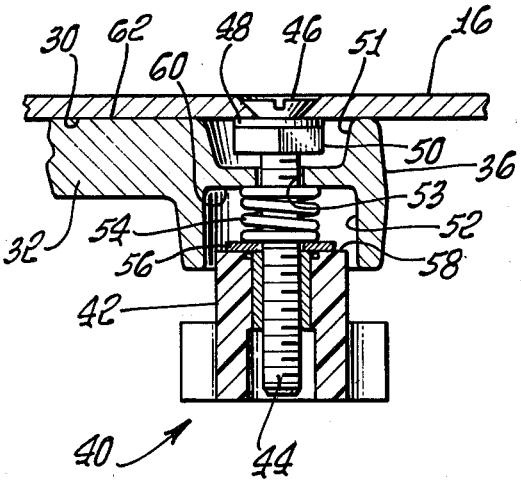
FIG. 3 is a partial enlarged sectional view taken along lines 3—3 of FIG. 2.
Figure 4:
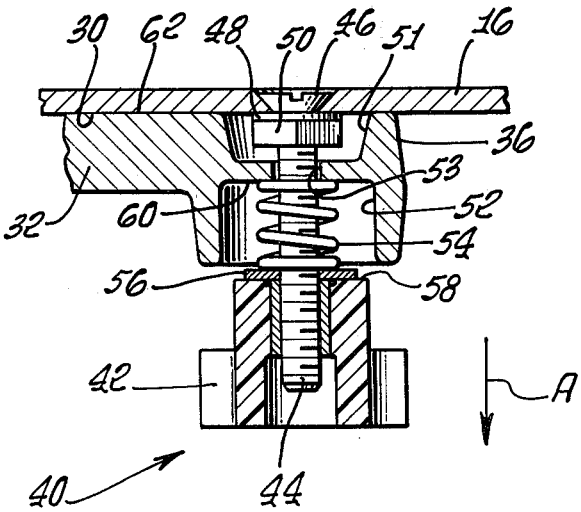
FIG. 4 is a sectional view similar to FIG. 3 with the adjustment knob in its complete loosened position.

A more detailed representation of the flexibility control member 40 is shown in FIG. 3 and 4. The control assembly 40, which is of the same construction as control assembly 38, comprises an adjustment knob 42 threaded on a connection bolt 44 which is secured to the central portion 16 of the board by a counter-sunk bolt head 46 and a lock washer 48 with a tightly secured nut 50. The rear end 36 of the strengthening member 32 has a recessed area 51 to receive the respective washer 48 and nut 50, and also has a bolt aperture 53 to loosely receive the bolt 44. An adjustment cavity 52 centered over and larger than the bolt aperture 44 receives a spring 54 surmounted on the bolt 44 as well as a head washer 56 which is forced against the spring when the adjustment knob 42 is tightened toward the skateboard 10. The adjustment knob has a forcing surface 58 which presses against the washer 56 to compress the spring 54 against the bottom 60 of the adjustment cavity 52. Consequently, when the adjustment knob 42 is turned on the bolt 44 in the direction toward the board 10, the forcing surface 58 of the adjustment knob 42 causes the washer 56 to compress the spring against the bottom 60 of the adjustment cavity 52 in the rear end 36 of the beam 32, thereby shortening and preloading the spring. When the forward flexibility control assembly 38 and the rear control assembly 40 are both in the position shown in FIG. 3 with spring 54 completely compressed, the beam 32 will cause the central portion 16 of the board to be essentially rigid as the spring is bottomed-out and the beam 32 is thereby rigidly connected to the board. In this position the beam 32 becomes a support beam for the central portion 16, providing greater strength to the central portion to essentially eliminate deflection when a typical user's weight is placed on the skateboard.

Figure 5:
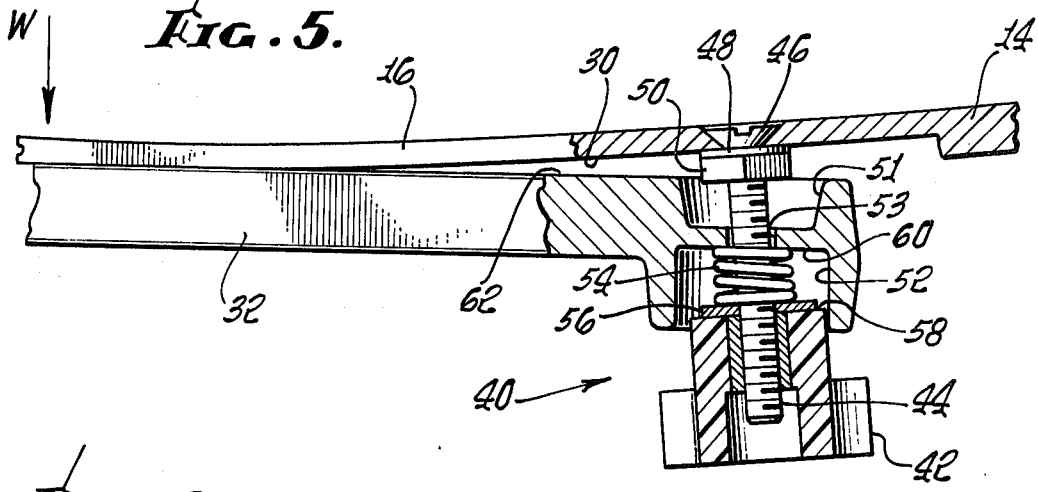
FIG. 5 shows in section the deflection in the board when the adjustment knob is in its loosened position.

When the adjustment knob 42 in FIG. 4 is moved in the direction of the arrow A, so that it is as far away from the board as possible on the bolt 44, the spring 54 will expand so that the board 10 is no longer rigidly connected to the beam 32, but is connected through the expanded spring 54 which biases the beam toward the bottom 30 of the board. When both of the respective flexibility control assemblies 38 and 40 are oriented to the position shown in FIG. 4 and a weight is applied to the board as shown in FIG. 5, the central portion 16 of the board will move downward or deflect. The center of the beam 32 will be forced down by the deflecting center of the board, and the ends of the rigid beam 32 will, therefore, also move down while the ends of the board 10 will not. Thus, the ends of the beam 32 will move downward away from the board 16. That separation of the beam ends from the board is resisted by the springs. Thus, the springs resist deflection of the board 16. Within the limits of the springs, the beam can move downwardly so that its ends are away from the board because of the available movement between the forcing surface 58 of the adjustment knob 42 and bottom 60 of the adjusting aperture in the strengthening member, thereby permitting the center portion of the board to flex under load. The bias of the spring 54 will maintain the contact between the beam 32 and the board when no load is on the board. When the board 16 deflects to a maximum position where the spring 54 is control assembly 40 is completely compressed within the adjustment cavity 52 by the downward movement of the rear end 36 of the beam 32 the beam will prevent further deflection of the board. Therefore, the deflection of the central portion 16 of the board causes the strengthening member to move downward against the bias of the spring 54 and the spring (not shown) in control assembly 38. The bias of the spring 54 as well as the spring in control assembly 38 exerts a varying upward force on the ends of the beam resisting deflection of the board as the adjustment knobs 42 and 64 are moved toward and away from the beam and the preload on the spring is varied. Therefore, the springs in conjunction with the adjustment knobs cause the variable flexibility in the board.

The board 10 is preferably made of cast aluminum with the thinned-down central portion 16 and the wheel assembly mounting brackets 22 and 24 being integral parts of the casting.

In operation of the preferred embodiment of the invention as shown in FIGS. 1 through 5, the user simply adjusts or dials the respective flexibility control members 38 and 40 by their respective adjustment knobs or dials 64 and 42. The respective knobs should be turned on their respective bolts to a position as close as possible to the beam 32 or the board 10 if it is desired to obtain an essentially rigid skateboard. If maximum flexibility is desired, the respective adjustment knobs 64 and 42 are loosened to a position on the bolts remote from the strengthening member. If any intermediate flexibility or deflection is desired, the user, through trial and error dialing of the knobs 64 and 42, can obtain the desired deflection to best suit his needs according to his weight and the maneuver to be made.

Figure 6:
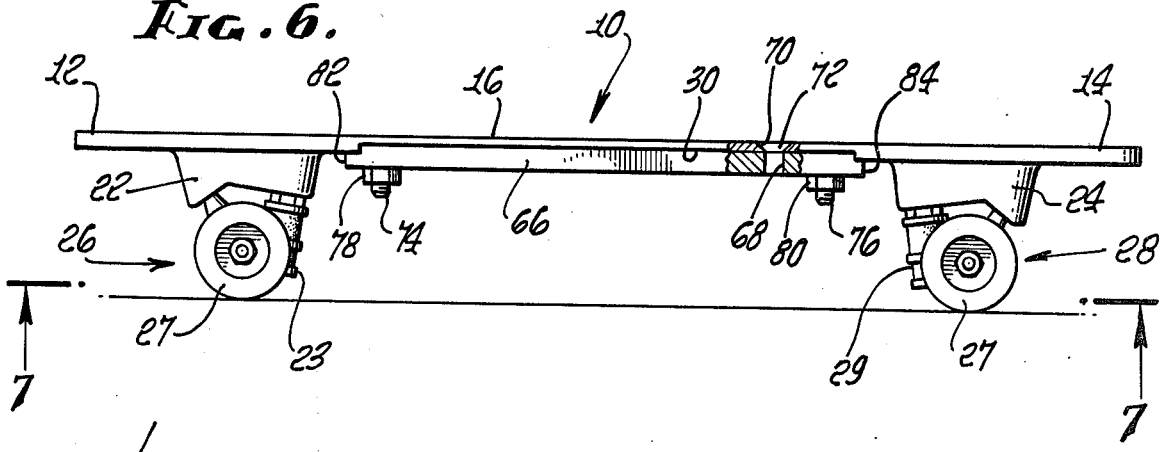
FIG. 6 is a side elevational view of an alternate embodiment of the invention.
Figure 7:
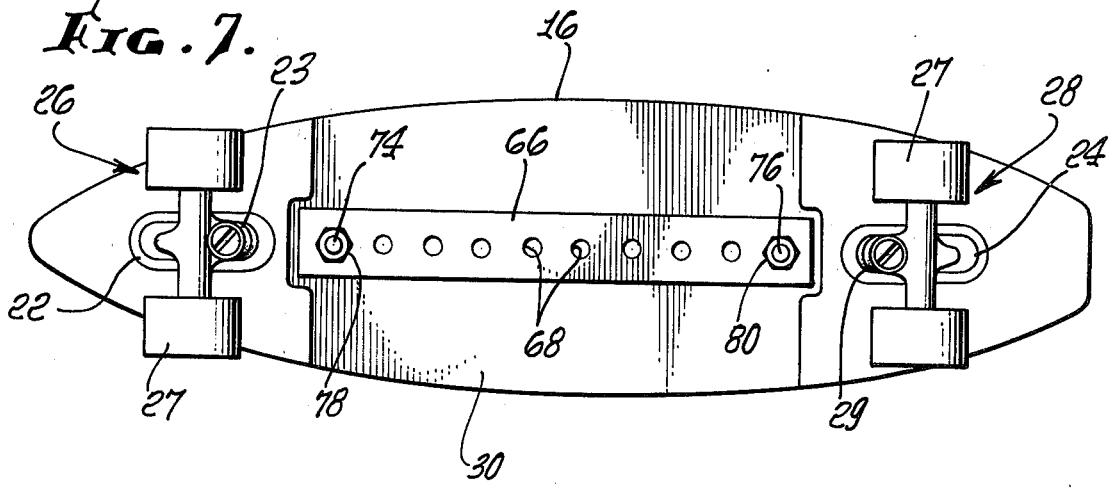
FIG. 7 is a bottom view of an alternate embodiment of the invention.
Figure 8:
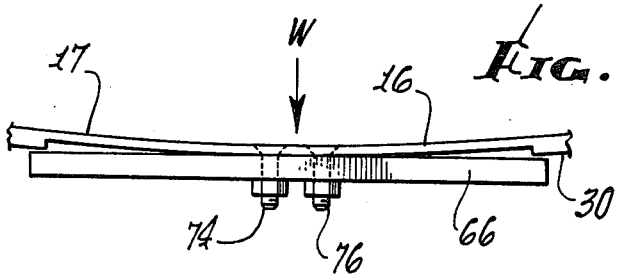
FIG. 8 is a partial side elevation showing the maximum deflection position in the alternate embodiment of the invention.

With respect to FIGS. 6 through 8, a second embodiment of the invention is shown with a strengthening member or beam 66 mounted on the bottom surface 30 of the central portion 16 of the board 10. As shown in FIG. 7, the beam 66 has a series of apertures 68 throughout its length. Located in alignment with the apertures 68 of the beam 66 are a series of apertures 70 in the central portion 16 of the board 10 with respective counter-sunk areas 72. The adjustment of the flexibility in the central portion of the board is determined by the location of a pair of fastening members or bolts 74 and 76 and nuts 78 and 80 in the respective apertures 68 and 70 of the board and strengthening member.

In order to make the board essentially rigid, the bolts 74 and 76 are respectively positioned in the apertures 68 which are closest to the front end 82 and rear end 84 of the beam 66 as shown in FIGS. 6 and 7. Consequently, the beam 66 essentially eliminates deflection in the board when it is supporting a typical young person.

In order to obtain a maximum deflection the respective bolts 74 and 76 are placed in the apertures 68 and 70 which are closest to the center of the beam as shown in FIG. 8, thereby reducing the effective length of the beam. Consequently, when the weight W of a typical young person is placed on the upper surface 17 of the board, the board is free to flex over the major length of its center portion, except for the short part of its length between the two bolts 74, 76 which is still held rigid by the beam. This allows the central portion 16 to deflect downward. Varying degrees of flexibility can be obtained by moving bolt 74 from its generally central position in FIG. 8 aperture by aperture 68 out toward the end 82 of beam 66 and by moving bolt 76 from its position in FIG. 8 similarly aperture by aperture 68 out toward the opposite end 84 of the beam 66. The bolts 74 and 76 preferably should be the same number of apertures from the respective ends 82 and 84 of the beam 66 to provide proper deflection in the board. At each location of the bolts 74 and 76 the respective nuts 78 and 80 are securely tightened on the bolts. The flexibility of the board will decrease as the bolts are moved out toward the respective end 82 and 84 of the beam 66, because the effective length of the beam is increased.

What is claimed is:

1. A selectively adjustable flexible skateboard comprising:

an elongate board having a bottom surface and a top surface;

a first wheel assembly mounted on said bottom surface adjacent one end of said board;

a second wheel assembly mounted on said bottom surface adjacent the other end of said board;

a strengthening member mounted between said first and second wheel assemblies; and means connected between said strengthening member and said board for adjusting the flexibility of said board having a specified load, said means comprising:

a threaded shaft extending through an aperture in both said board and said strengthening member; and an adjusting member mounted on said threaded shaft and located beneath said strengthening member, said adjusting member movable between a first position and a second position, said adjusting member in said first position allowing relative movement between said board and said strengthening member to permit a specified deflection in said board from a weight placed on said board, said board not moving relative said strengthening member when said adjusting member is in said second position resulting in significantly less deflection in said board with said weight than said specified deflection.

2. A skateboard as defined in claim 1 and additionally comprising biasing means disposed between said strengthening member and said adjusting member for varying the deflection of said board with said weight as said adjusting member is moved between said first and second positions.

3. A skateboard as defined in claim 2 wherein said biasing member is a spring surmounted on said threaded shaft and connecting said strengthening member and said board.

4. A skateboard as defined in claim 2 wherein two of said adjusting means are spaced longitudinally along said strengthening member.

5. A skateboard comprising:

a board having an upper and a lower surface;

a first wheel assembly mounting leg integrally formed on said lower surface adjacent one end of said board;

a second wheel assembly mounting leg integrally formed on said lower surface adjacent the other end of said board;

a first truck and wheel set secured to said first wheel assembly mounting leg;

a second truck and wheel set secured to said second wheel assembly mounting leg;

a rigid beam attached to said lower surface of said board between said first and second wheel sets; and means connected between said beam and said board for adjusting the flexibility of said board, said means comprising:

a first bolt extending down from said board adjacent said first wheel assembly mounting leg;

a second bolt extending down from said board adjacent said second wheel assembly mounting leg, said first and second bolts extending through the ends of said rigid beam;

an adjustment knob threaded respectively on each of said first and second bolts and located beneath said rigid beam, said knobs movable to a plurality of positions on said bolts respectively between a completely locked orientation and a completely loosened orientation; and a spring surmounted on each of said bolts between said knobs and said rigid beam to exert varying forces on said rigid beam against said board as said knobs are moved toward and away from said strengthening member.

6. A skateboard comprising:

an elongate board having a central portion and respective end portions, said central portion having less thickness than said end portions;

an integral bracket member located on each of said end portions;

a wheel assembly mounted on each of said bracket members;

an elongate rigid beam positioned on the lower side of said central portion between said wheel assemblies;

a bolt at each end of said beam extending down from said board and through an aperture at each end of said beam;

an adjustable knob threaded on each of said bolts and located beneath said rigid beam, said knobs movable to a plurality of positions between a first position closest to said beam and a second position remote from said beam along said bolt; and biasing means between said knob and said beam for exerting varying forces on said ends of said beam against said board as said knobs are moved toward and away from said beam to vary the deflection in said central portion for a specified load.

* * * * *